United States Patent [19]

Bentvelzen et al.

[11] 4,295,925

[45] Oct. 20, 1981

[54] TREATING PULP WITH OXYGEN

[75] Inventors: Jozef M. Bentvelzen, Sumner; Michael D. Meredith, Federal Way, both of Wash.; Henry Bepple, Kamloops, Canada; Louis O. Torregrossa, Puyallup, Wash.; Howard R. Battan, Auburn, Wash.; Dennis H. Justice, Everett, Wash.

[73] Assignee: Weyerhaeuser Company, Tacoma, Wash.

[21] Appl. No.: 48,935

[22] Filed: Jun. 15, 1979

[51] Int. Cl.[3] ..... D21C 9/04; D21C 9/10; D21D 5/28

[52] U.S. Cl. ..... 162/19; 162/22; 162/57; 162/60; 162/65; 162/243; 162/247

[58] Field of Search ..... 162/24, 65.60, 57, 243, 162/19, 22, 247, 23, 21; 366/102, 103, 104, 157, 167, 178, 303; 8/149.1, 156, 109, 111; 68/5 B, 5 C, 5 D, 5 R, 181 R, 183

[56] References Cited

U.S. PATENT DOCUMENTS

| | | | |
|---|---|---|---|
| 1,827,710 | 10/1931 | Leyst-Kuchermeister | 162/57 |
| 3,293,117 | 12/1966 | Pennington | 162/243 |
| 3,769,152 | 10/1973 | Samuelson | 162/65 |
| 3,832,276 | 9/1974 | Roymoulik et al. | 162/65 |
| 4,023,737 | 3/1976 | Leider et al. | 241/261.3 |
| 4,039,154 | 8/1977 | Peterson | 241/261.3 |
| 4,082,233 | 4/1978 | Reinhall | 162/24 |
| 4,093,506 | 6/1978 | Richter | 162/57 |

OTHER PUBLICATIONS

Kleppe et al. "Oxygen/Alkali Delignification at Kamyr Digester Blowline Consistency" Nov. 1976, vol. 59, No. 11 *Tappi.*

Myburgh et al. "A Continuous Process for Bleaching of Pulps" 23rd Alkaline Bleaching Conf. 1969.

Kirshner et al. "Low Consistency Oxygen Delignification in a Pipeline Reactor".

Rapson "The Bleaching of Pulp" TAPPI Monograph Series No. 27, p. 332.

Jamieson et al. "Mill Scale Application of Oxygen Bleaching in Scandanavia" 1973 Alkaline Pulping Conf.

"The Asplund RL 50 S Raffinator" Defibrator Oct. 1971.

"Rauma-Repola Double Shaft Mixer" Bulletin (no date avail.).

*Primary Examiner*—S. Leon Bashore
*Assistant Examiner*—Steve Alvo
*Attorney, Agent, or Firm*—Weyerhaeuser Company

[57] ABSTRACT

Washed wood pulp from a continuous digester is treated with oxygen in the blow line from the digester. Most of the treatment occurs within the mixer. The mixer has a mixing zone with a swept area of 10,000 to 1,000,000 square meters per metric ton of oven-dry pulp. A preferred range is 25,000 to 150,000 square meters per ton of oven-dry pulp and an optimum range is around 65,400 square meters per metric ton of oven-dry pulp. Following mixing, the pulp may be taken to a subsequent process, a diffusion washer, or to a storage tank.

40 Claims, 15 Drawing Figures

Fig. 4
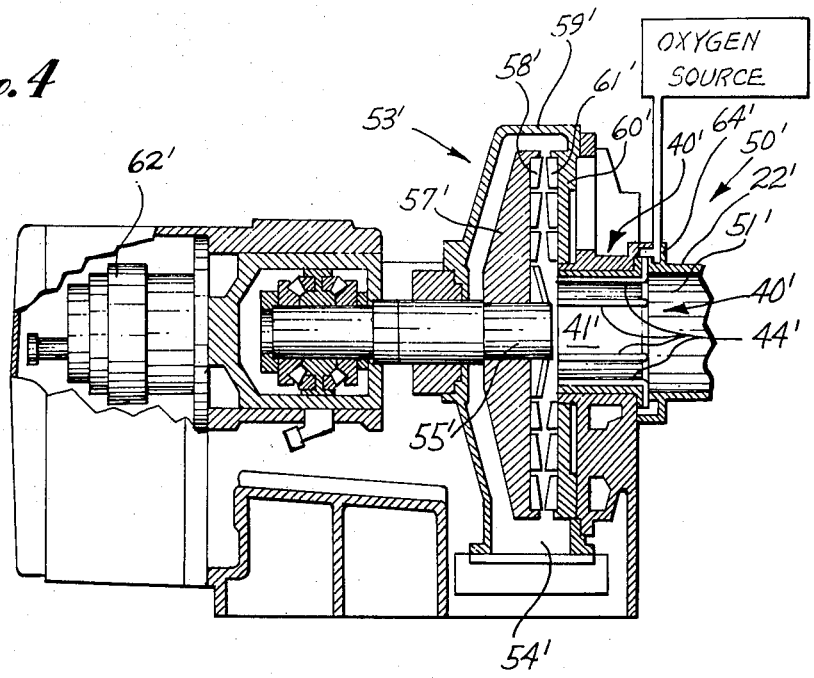
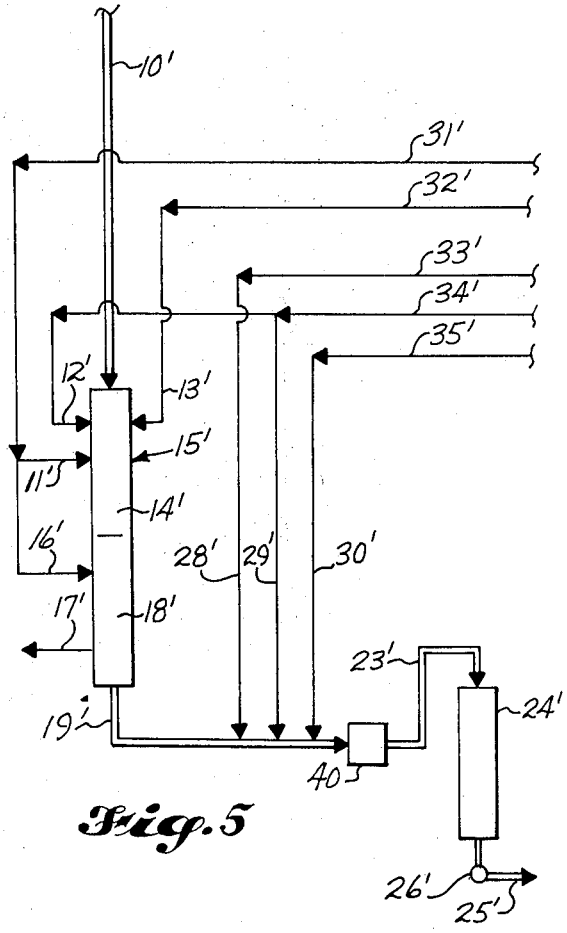
Fig. 5

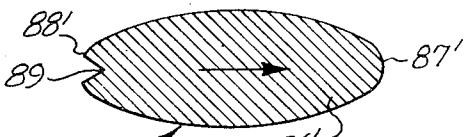
Fig. 12
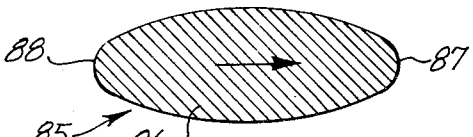
Fig. 10
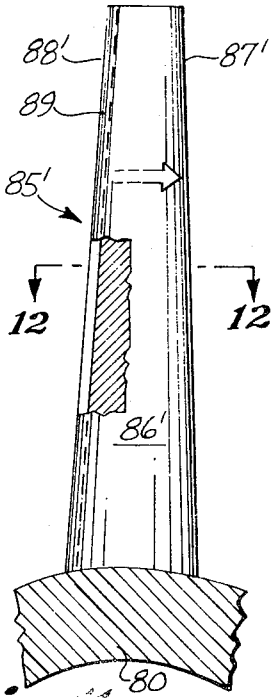
Fig.
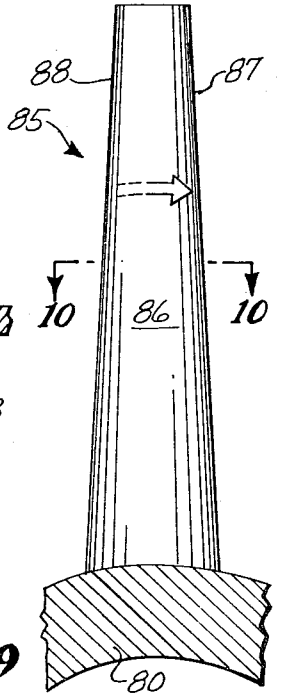
Fig. 9
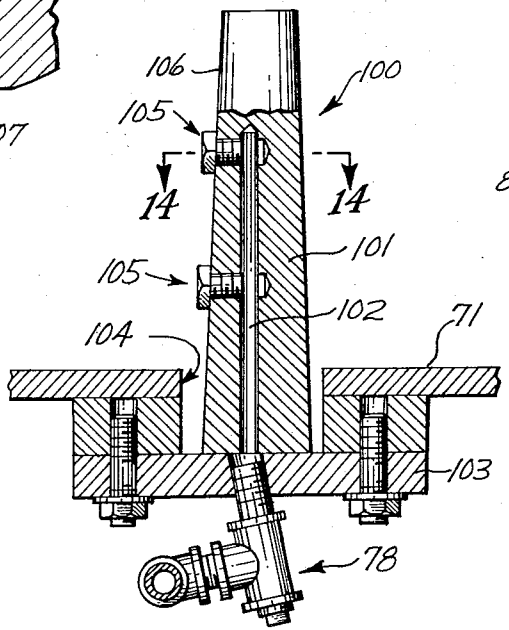
Fig. 13
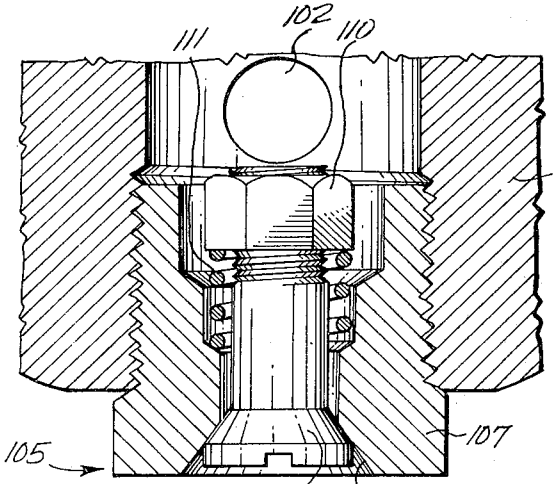
Fig. 15
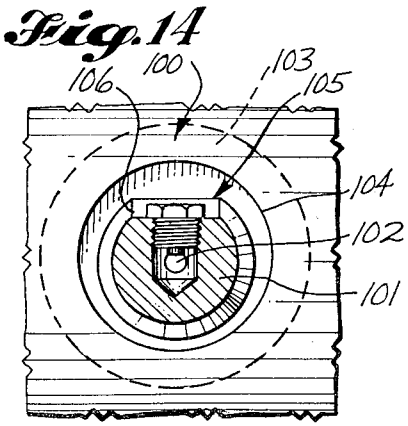
Fig. 14

TREATING PULP WITH OXYGEN

BACKGROUND OF THE INVENTION

1. Field of the Invention

Treating wood pulp with oxygen.

2. Review of the Prior Art

The following definitions will be used in this application.

Pulping is a changing of wood chips or other wood particulate matter to fibrous form. Chemical pulping requires cooking of the chips in solution with a chemical and includes partial removal of the coloring matter such as lignin associated with the wood.

Bleaching is the treatment of cellulosic fibers to remove or alter the coloring matter associated with the fibers to allow the fiber to reflect white light more truly.

Pulp quantity is expressed in several ways.

Oven dry pulp is considered to be moisture free or done dry. Its value is determined by drying the pulp in an oven at a temperature of 100° to 105° C. until it reaches constant weight. It usually is considered to have reached constant weight after 24 hours in the oven.

Air-dry pulp is assumed to have a ten percent moisture content. One air-dry ton of pulp is equal to 0.9 oven-dry tons of pulp.

There are two principal types of measurements to determine the completeness of the pulping or bleaching process, the degree of delignification and the brightness of the pulp. There appears to be no correlation between the two because the delignification factor is a measure of residual lignin within the pulp and the brightness is a measure of reflectivity of the pulp sheet.

The degree of delignification is normally used in connection with the pulping process and the early bleaching stages. It tends to be less precise when only small amounts of lignin are present in the pulp.

The brightness factor is normally used in connection with the bleaching process because it tends to be less precise when the pulp is dark and its reflectivity is low.

There are many methods of measuring the degree of delignification but most are variations of the permanganate test.

The normal permanganate test provides a permanganate or K number which is the number of cubic centimeters of tenth normal potassium permanganate solution consumed by one gram of oven dried pulp under specified conditions. It is determined by TAPPI Standard Test T 214.

The Kappa number is similar to the permanganate number but is measured under carefully controlled conditions and corrected to be the equivalent of 50 percent consumption of the permanaganate solution in contact with the specimen. It is able to give a degree of delignification of pulps through a wider range of yields than does the permanganate number. It is determined by TAPPI Standard Test T-236.

There are also a number of methods of measuring pulp brightness. It usually is a measure of reflectivity and its value is expressed as a percent of some scale. A standard method is GE brightness which is expressed as a percentage of a maximum GE brightness as determined by TAPPI Standard Method TPD-103.

Pulp yield may be measured in two ways. The first is the amount, by weight, of carbohydrates and lignin returned per unit of wood. Screened yield is closely related and proportional to this chemical return. A high screened yield means the chemical return is high and a low screened yield means the chemical return is low. The second measurement of yield is fiber yield, by weight, per unit of wood. Rejects or screenings are related to and inversely proportional to the fiber yield. A high reject level means there is a low fiber return and a low reject level means there is a high fiber return. The total yield is the sum of these two yields. The ideal situation would be one in which there is a high chemical return and a high fiber return indicated by a high screened yield and low screenings.

There is a great deal of art which describes both oxygen bleaching of pulp or refining of pulp. Consequently, the present discussion of the prior art will not be exhaustive but will consider only those patents and articles which appear to be quite pertinent to the present application.

The first of these is Laakso U.S. Pat. No. 4,002,528, which issued Jan. 11, 1977. This patent describes one environment for the present invention—two refiners 34 and 35 within the blow line 32 between digester 24 and a storage tank 38. This environment is usually encountered in a linerboard mill. The digester in a bleached pulp mill normally would not have refiners in the blow line.

The following patents are exemplary of those describing various oxygen treatment systems.

Grangaard, et al. U.S. Pat. No. 3,024,158, which issued Mar. 6, 1962 discloses the oxygen treatment of pulp to minimize brightness reversion. FIGS. 1 and 2 disclose a two-vessel system in which oxygen is added to the liquor in one vessel and the pulp treated with the oxygenated liquor in a second vessel.

Grangaard, et al. state that time of the reaction depends upon the temperature of the reaction. The time may be varied between 5 minutes to 3 hours at the reaction temperatures of between 100° and 160° C. Although the process may be used on unbleached kraft and other pulps of low brightness, it is preferable to use it with bleached pulp. Examples 1–8 of this patent describe treatment of unbleached kraft pulps. The time of treatment was 60, 120, and 180 minutes.

The patent also describes two ratios that are important when using oxygen and the parameters of these ratios. The first is the ratio of the oxygen pressure in the atmosphere in contact with the solution to the vapor pressure of the solution at the reaction temperature. It should be at least 0.35 and preferably 0.5 or more. The second is the ratio of the surface area of the solution in contact with the oxygen-containing atmosphere in square feet to the volume of the solution in cubic feet. It must be greater than 4.

FIG. 3 of the patent discloses an in-line system in which pulp is passed through a heat exchanger 23 and then continuously fed through a turbo mixer 24 while oxygen under pressure of at least 40 pounds per square inch is introduced. The treated pulp is discharged into a stock chest 22.

The Kamyr blow line oxygen system is described in Richter, U.S. Pat. No. 3,963,561 which issued June 15, 1976, and in Kleppe et al "Oxygen Alkali Delignification at Kamyr Digester Blow Line Consistency—a status report," 1976 International Pulp Bleaching Conference, May 2–6, 1976, TAPPI November 1976, Vol. 59, No. 11, pps. 77–80. In this system, oxygen is added to the pulp in the blow line between the digester and the oxygen reactor. The oxygen is added just prior to the refiner at the bottom of the reactor. The pulp is at a consistency of 5–20 percent and preferably 8–12 percent. The reactor is of an upflow-downflow type in which the pulp and oxygen are carried upward in a conical inner section of the reactor and flow downward in the outer section of the reactor. The oxygen reacts with the pulp in the upflow section of the reactor where the pulp must remain for from 20–30 minutes. During this portion of the cycle, the pulp is 90 percent oxidized. In the pilot plant the retention time in the inner section of the reactor was 40 minutes.

There are a number of mechanical features within the reactor to keep the pulp from floating to the top and to ensure that the pulp remains within the conical inner section of the reactor the appropriate length of time. The patent is directed to the reuse of the excess oxygen within the system.

The article describes the system in use at the Moss Norway plant.

Another approach is suggested in the International Paper patents to Roymoulik et al, U.S. Pat. No. 3,832,276, which issued Aug. 27, 1974, and to Phillips, U.S. Pat. No. 3,951,733, which issued Apr. 20, 1976.

The process requires a pulp at a consistency of less than 10 percent, preferably about 2 to 6 percent and most desirably between 3 and 4 percent. The pulp is mixed with oxygen is a high shear mixing device and the slurry is introduced into a vessel. The slurry rises upwardly through the vessel. There is no substantial agitation of the fibers as they rise upward, and the pressure on the pulp is then gradually reduced. The maximum pressure difference is between 1 and 10 atmospheres. This is preferably done in a bleach tower having a height of between 40 and 300 feet.

"Generally speaking from about 5 to 120 minutes is sufficient. For the higher initial pressure provided by the higher tower the time can be reduced to a period of from about 1 minute to 60 minutes. With a 40 foot tower providing a pressure differential of roughly about 1 atmosphere about 30 to 60 minutes, preferably about 40 minutes is satisfactory."

The oxygenated pulp does not go directly to the tank. Between the mixer and the tank are a heat exchanger 5, a vent 7, and optionally a prepressurizing chamber 6.

The Rauma-Repola system is described in the Federal Republic of Germany Pat. No. 24 41 579, Mar. 13, 1975 and in Yrjala et al, "New Aspects in Oxygen Bleaching," dated Apr. 18, 1974. The system uses the Vortex mixer shown in FIGS. 2 and 3 of the patent. It is possible, by using either a number of passes through a single mixer or several mixers, to bleach the pulp in from 5 to 15 minutes.

Yrjala, et al. "A new reactor for pulp bleaching" Kemian Teollisuus 29, No. 12: 861–869 (1972) describes a chlorine reactor.

Reinhall U.S. Pat. No. 4,082,233 discloses a refiner having means for removing excess gas before the stock enters the refiner.

SUMMARY OF THE INVENTION

The usual oxygen systems require a capital investment of several million dollars because of the large vessels employed.

The present system eliminates both the need for heavy capital expenditures and for lengthy times in which to do oxygen treatment. The pulp is treated with oxygen in the blow line of a continuous digester, after the pulp is washed in the digester. Alkali, steam and oxygen are added to the blow line and the oxygen reacted with the pulp. The mixer should have a mixing zone with a swept area of 10,000 to 1,000,000 square meters per metric ton of oven-dry pulp. A preferred range is 25,000 to 150,000 square meters per metric ton of oven-dry pulp and the optimum range is around 65,400 square meters per metric ton of oven-dry pulp. Much of the treatment occurs in a short time. An extensive reaction period in a pressure vessel is not required. The blow line may carry the pulp to either a storage tank, a diffusion washer or other processing. These are not a necessary part of the oxygen treatment.

BRIEF DESCRIPTION OF THE DRAWINGS

FIGS. 3 and 4 are cross sections of refiners, each with the diffuser of FIG. 2.

FIG. 5 is a diagram of a modified apparatus and process.

FIG. 9 is a plan view of a rotor.

FIG. 10 is a cross section of the rotor taken along line 10—10 of FIG. 9.

FIG. 11 is a plan view, partially in cross section, of a modified rotor.

FIG. 12 is a cross section of the modified rotor taken along line 12—12 of FIG. 11.

FIG. 13 is a plan view, partially in cross section, of a stator.

FIG. 14 is a cross section of the stator taken along line 14—14 of FIG. 13.

FIG. 15 is a cross section of a check valve.

DESCRIPTION OF THE PREFERRED EMBODIMENT

Figure 1:
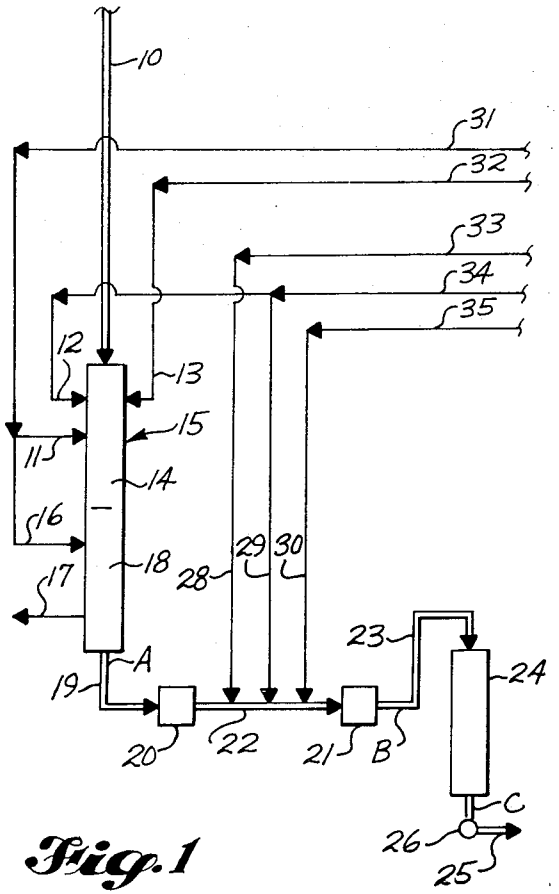
FIG. 1 is a diagram of the process and apparatus.
Figure 6:
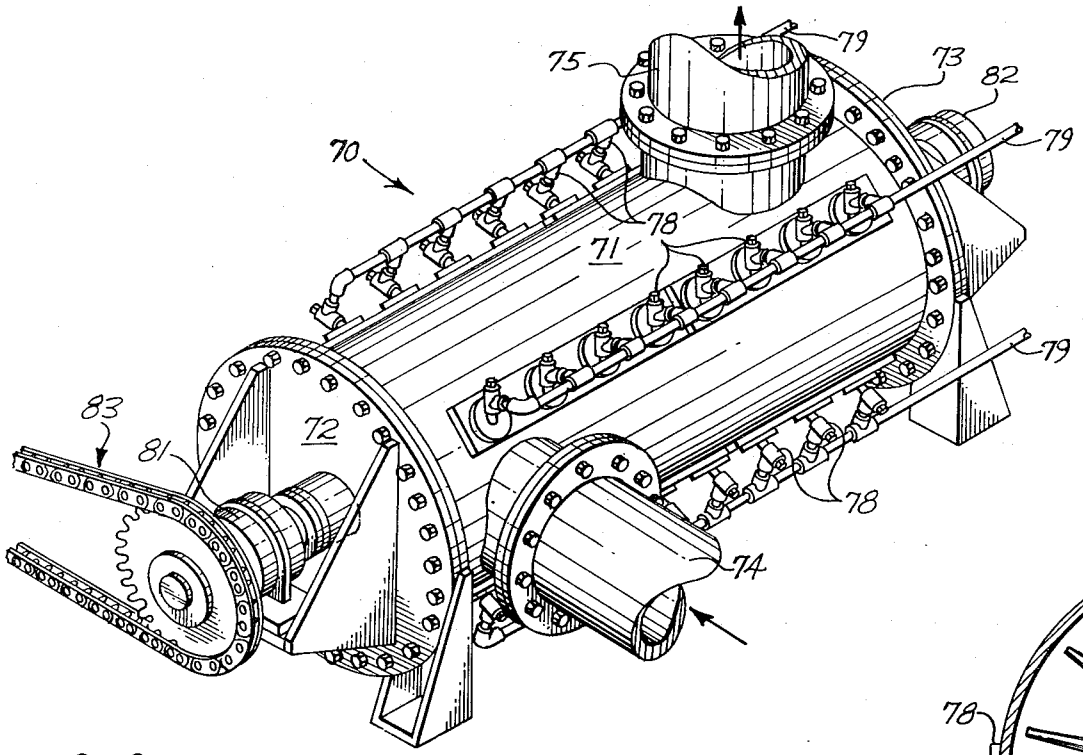
FIG. 6 is an isometric view of a mixer.
Figure 8:
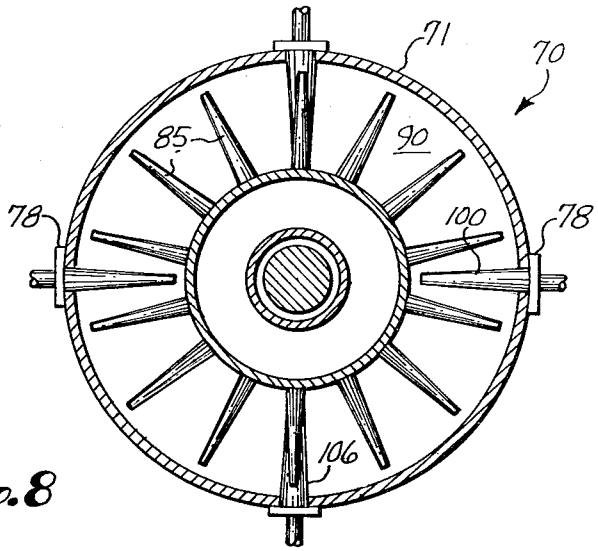
FIG. 8 is a cross section taken along line 8—8 of FIG. 7.
Figure 7:
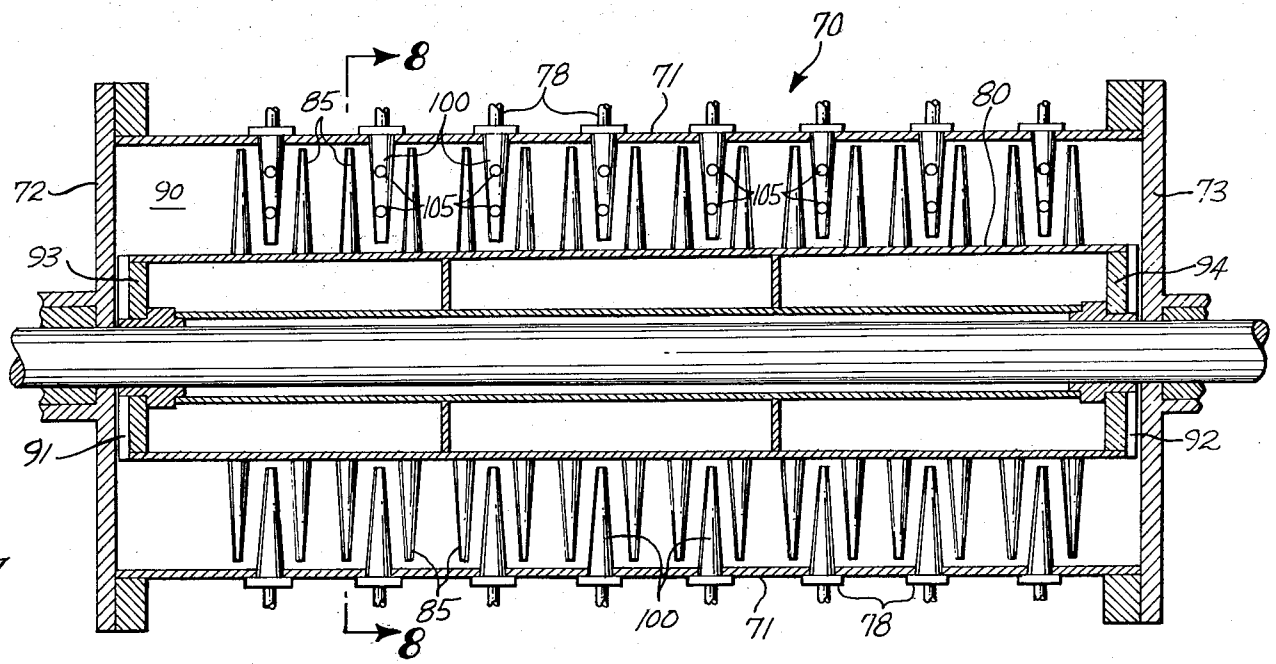
FIG. 7 is a cross section of the mixer of FIG. 6.

FIG. 1 is a diagram of the process.

Chips 10, process water 11, steam 12, and pulping chemicals 13 are fed to the pulping section 14 of a continuous digester 15. The wood chips 10 may be treated prior to entering the digester 15. This is optional. Exemplary of such treatment are presteaming of the chips in a steaming vessel or impregnation of the chips with the digestion chemicals in an impregnation vessel prior to entering the digester. The chemicals 13 entering the digester will depend on the process being used, be it sulfate, sulfite, or soda. The chips are cooked in the pulping section 14 under conditions appropriate to the chemicals, wood species and type, and size of chip. These conditions are well known.

The products of the digestion process are the delignified or partially delignified wood chips, the spent pulping chemicals, and the lignin and carbohydrate products which have been removed from the wood chips in the digestion process. A major portion of the spent pulping chemicals and lignin products are removed from the chips prior to further processing. In the continuous digester shown, the chips are washed in the washing section of the digester. This is indicated by process water 16 entering and the effluent stream 17 leaving the washing stage 18 of digester 15. The effluent stream 17 will consist of the lignin and carbohydrates which have been removed from the chips during the digestion process and the spent digestion chemicals. This effluent will be carried to a treating facility. In the case of kraft or sulfate pulp, this would be a recovery system in which the liquor is burned to recover the digestion chemicals for reuse.

Following this treatment, the chips will pass from the digester 15 through the blow line to storage or blow tank 24. Tank 24 would usually be a storage tank or blow tank. It is customary in pulp mills to have storage tanks between processing steps so that the entire mill will not shut down if one section of the mill is shut down. Storage tank 24 is one such tank. It would be between the digester stage and the subsequent processing stages. The storage tank 24 is open to the atmosphere and at atmospheric pressure. Line 25 and pump 26 carry the pulp from the tank 24.

Tank 24 may be a diffusion washer instead of a storage tank. Diffusion washers are described in Rydholm *Pulping Processes,* Interscience Publishers 1965, pages 725–730 and illustrated in FIG. 10.14 on page 728. The diffusion washer would be followed by a storage tank.

Tank 24 in FIG. 1 or 24' in FIG. 5 indicate either a storage tank, a diffusion washer or a diffusion washer followed by a storage tank.

The material passing through the blow line is a slurry which contains the remaining lignin and carbohydrates, the spent digestion chemicals, and the fibers formed from the chips as they are blown from the digester. The chips will be formed into fibers when the pressure on the chips is partially released, usually at the exit of digester 15. The slurry will still be under some pressure to move it through the blow line. If the digester is continuous, then additional fiberizing may be done by a refiner, or refiners, in the blow line. The refiners will fiberize the large particles or fiber bundles that have not been reduced to fibers earlier in the process. In the present diagram, two refiners—refiners 20 and 21—are shown. In the two-refiner system, the first refiner 20 does course refining and the second refiner 21 does fine refining.

The blow line is shown in three sections—section 19 between the digester 14 and refiner 20; section 22 between the refiners 20 and 21; and section 23 between the second refiner 21 and the tank 24.

The purpose of the present invention is to treat the washed pulp with oxygen with as little change to the equipment as possible. Sodium hydroxide and steam are added to the pulp slurry in line 22 between refiners 20 and 21. Sodium hydroxide, which both adjusts the pH of the pulp and buffers the oxygen reaction, is added through line 28. Other suitable alkalies, such as white liquor, may also be used. Steam is added through line 29. The steam raises the temperature of the pulp to a temperature appropriate for the oxygen treatment. Oxygen is added through line 30. In a two-refiner system, the addition of the chemicals and steam prior to the second refiner is preferable because there are more individual fibers in the second refining stage.

The lines used to carry these various chemicals to the process are shown in the upper section of FIG. 1. Line 31 carries process water to lines 11 and 16. Line 32 carries chemicals to line 13. It may represent a number of chemical lines. Line 33 carries sodium hydroxide to line 28. Line 34 carries steam to lines 12 and 29. Line 35 carries oxygen to line 30. In some instances, the alkali is used both as a digestion chemical and for the oxygen treatment, as in the soda process in which sodium hydroxide is used for both digestion and oxygen treatment, or the kraft process in which white liquor is used for both digestion and oxygen treatment. In this case, lines 32 and 33 would be the same line.

The pulp should be washed prior to the oxygen treatment. Otherwise too much of the oxygen will be used in reaction with the delignification products and not with the pulp fibers. This is the reason for a continuous digester which has washing in the digester prior to the blow line.

The amount of oxygen used will depend upon the yield and K or Kappa number of the pulp to be treated, and the desired result of the treatment. Between 5 and 50 kilograms of oxygen per metric ton of oven-dry unbleached wood pulp is required for the oxygen treatment.

In a low yield, low Kappa number pulp the purpose of oxygen treatment would normally be bleaching. The actual yield and Kappa number would depend on the pulping process used, but these pulps are used for bleached products. The blow line and brownstock Kappa number for pulp being used in bleached products is usually around 30 to around 40. The amount of oxygen used to bleach the pulp would be between 5 and 40 kilograms per metric ton of oven-dry pulp.

In a high yield, high Kappa number pulp of the type usually used for linerboard the purpose of the oxygen treatment is to improve certain properties of the product. The blow line and brownstock Kappa number for this pulp is usually around 80 to around 120. This allows the mill either to increase certain property values of the product at the same pulp yield or to maintain the property value while increasing the yield. As an example, the application of 12 to 50 kilograms of oxygen to a high yield, high Kappa number pulp will either increase the ring crush of a liner prepared from the pulp or maintain the ring crush at the same value and increase the yield. Ring crush is determined by TAPPI Standard T 818 OC-76.

Other conditions may need adjusted for oxygen treatment. The pH should be between 8 and 14. In this environment, the amount of alkali, expressed as sodium hydroxide, required to obtain this pH is between 0.25 to 8% of the oven-dry weight of the unbleached wood pulp. The temperature is usually between around 65° C. to around 121° C. The pulp from the digester may be at the temperature required for the oxygen reaction. If not, the pulp would be heated to either adjust it to or maintain it at the temperature required for the oxygen reaction during the mixing step.

In FIG. 1 there are three points labeled A, B, and C. A is in the blow line 19 after the continuous digester; B is in the blow line 23 after refiner 21; and C is in the outlet from storage tank 24. These are the three points at which samples were taken and tested in a mill trial of this invention.

The pulp left the continuous digester at a 71° F. and 1,380 kPa gage. Its pH was 10.5. The amount of unbleached pulp passing through the system from the digester throughout the test was 14.3 over-dry metric tons per hour. The pulp passed through the refiner 21 in up to 1.5 seconds, and remained in storage tank 24 about 50 minutes. The storage tank 24 was open to the atmosphere, and blow line 23 poured the slurry into the open tank.

The system was first tested for a period of approximately 6 hours to determine the amount of residual lignin in the unbleached pulp at point A and point C to determine if there were any bleaching effects in a standard system. Samples were taken at points A and C at the time intervals indicated in Table I, and the Kappa number of each of the samples was determined. The accuracy of the measurements of these discrete samples was checked during the test by taking a number of samples, averaging the Kappa numbers of these samples and comparing this average to the Kappa number of the discrete sample. These, the A Avg and C Avg Kappa numbers in Table I, and the discrete sample Kappa number, are within experimental accuracy.

The various Kapp numbers for the samples are shown in Table I.

TABLE I

| | | | Kappa Number | |
|---|---|---|---|---|
| Time | A | C | Diff | A Avg |
| 0:01 | 28.0 | | | |
| 0:35 | | 35.4 | | |
| 1:00 | 33.2 | | | |
| 1:30 | | 31.2 | | |
| 2:00 | 32.4 | | | |
| 2:30 | | 31.9 | | |
| 3:00 | 32.0 | | 32.5 | |
| 3:30 | | 29.9 | | 32.7 |
| 4:00 | 37.6 | | | |
| 4:30 | | 38.7 | | |
| 5:00 | 36.4 | | | |
| 5:30 | | 36.8 | | 37.8 |
| Avg | 33.3 | 34.0 | +0.7 | |

From these results, it can be seen that no bleaching occurred between sample point A, the outlet of digester 14, and sample point C, the outlet of storage tank 24.

Following the 6-hour control run without oxygen there was a 5¼ hour bleaching test using oxygen. The pH and temperature were between 7 and 14 and between around 65° C. and around 121° C. respectively.

During this test, the amount of oxygen added to the pulp was measured approximately every half hour and recorded in pounds of oxygen added per hour. This has been converted to kilograms per hour. Since the flow of unbleached pulp was substantially constant at 14.3 oven-dry metric tons per hour, it was possible to determine the amount of oxygen added in kilograms of oxygen per oven-dry metric ton of unbleached wood pulp.

During the test the oxygen flow varied from a low of 6.7 kilograms per oven-dry metric ton of unbleached pulp to a high of 40 kilograms per oven-dry metric ton of unbleached pulp. The average oxygen rate was 15 kilograms per oven-dry metric ton of unbleached pulp. Sodium hydroxide was added at a rate of 64 kilograms per oven-dry metric ton of unbleached pulp, and the steam was added at a rate of 612 kilograms per oven-dry metric ton of unbleached pulp. The pulp entered the second refiner 21 at a temperature of 70°–97° C., a pressure of 621 kPa gage and a pH of 12.5.

Pulp samples were again taken at points A and C at the time intervals indicated in Table II and the Kappa numbers of the pulp samples measured. This was to determine whether the oxygen bleached the pulp. These Kappa numbers are given in columns $A_1$ and $C_1$ in Table II. The Kappa number at point C was, on the average, 7.5 points less than the Kappa number at point A during the oxygen treatment, showing that bleaching occurred.

Another series of tests were made to determine where bleaching occurred in the system.

In the first part of these tests, samples were again taken at points A and C to see if there was a correlation between these tests and the other $A_1$–$C_1$ bleaching tests being made at the same time. The results of these correlation tests are in the columns $A_2$ and $C_2$ in Table II. It may be seen that the average Kappa number drop for the $A_2$ and $C_2$ tests, 7.8, and for the $A_1$ and $C_1$ tests, 7.5, were within experimental accuracy.

The second part of the tests was done during the $A_2$–$C_2$ tests. Samples were also taken at A and B and the Kappa numbers determined. The samples at B were taken at approximately the same time as the samples at A because the pulp is in the refiner for up to about 1.5 to 2 seconds. The maximum time in the refiner would be 10 seconds. The results of these tests are in columns $A_2$ and B of Table II. From these tests it can be seen that the Kappa number drop across the refiner 21 was 7.5, substantially the entire Kappa number drop between point A and point C. These tests indicate, within experimental accuracy, that the entire Kappa number drop, or delignification, occurs in the refiner between points A and B. The first Kappa number at B, 28.5, is the same as the corresponding Kappa number at $C_2$, and the second Kappa number at B, 31.4, is almost the same as the corresponding number at $C_2$, 31.5. Consequently, these tests have shown that bleaching occurs in the refiner 21 between the oxygen addition and point B.

TABLE II

| | $O_2$ | $O_2$ | Kappa Number | | | | | | | | | |
|---|---|---|---|---|---|---|---|---|---|---|---|---|
| Time | kg/hr | kg/t | $A_1$ | $C_1$ | Diff | $A_2$ | $C_2$ | Diff | $A_2$ | B | Diff | Avg |
| 6:00 | | | 35.0 | | | | | | | | | |
| 6:30 | | | | 26.4 | | | | | | | | 36.3 |
| 6:32 | 196 | 13.7 | | | | | | | | | | |
| 7:00 | 381 | 26.7 | 35.4 | | | | | | | | | |
| 7:30 | | | | 27.2 | | | | | | | | |
| 7:32 | 95 | 6.7 | | | | | | | | | | |
| 7:45 | | | | | | 36.3 | | | | | | |
| 8:00 | | | 35.1 | | | 37.4 | | | | | | |
| 8:02 | 238 | 16.7 | | | | | | | | | | |
| 8:15 | | | | | | 36.8 | 28.0 | | | | | |
| 8:30 | | | | 23.2 | | | 28.3 | | | | | |
| 8:31 | 191 | 13.3 | | | | | | | | | | |
| 9:00 | 191 | 13.3 | 36.0 | | | 37.4 | 29.7 | | 37.4 | 28.5 | −8.9 | |
| 9:30 | | | | 28.7 | | | 28.5 | | | | | |
| 9:40 | 179 | 12.5 | | | | | | | | | | |
| 10:00 | | | 32.1 | | | 37.4 | | | 37.4 | 31.4 | −6.0 | |
| 10:05 | 286 | 20 | | | | | | | | | | |
| 10:15 | 429 | 30 | | | | | | | | | | |
| 10:30 | | | | 29.0 | | | 31.5 | | | | | |
| 10:35 | 143 | 10 | | | | | | | | | | |
| 10:50 | 191 | 13.3 | | | | | | | | | | |
| 10:55 | 572 | 40 | | | | | | | | | | |

TABLE II-continued

| Time | $O_2$ kg/hr | $O_2$ kg/t | Kappa Number $A_1$ | $C_1$ | Diff | $A_2$ | $C_2$ | Diff | $A_2$ | B | Diff | Avg |
|---|---|---|---|---|---|---|---|---|---|---|---|---|
| 11:15 | | | | 28.8 | | | | | | | | |
| Avg | 214 | 15 | 34.7 | 27.2 | −7.5 | 37.0 | 29.2 | −7.8 | 37.4 | 29.9 | −7.5 | |

The brightness of samples taken at points A and B was also checked. The average brightness of $A_2$ pulp samples was 18.9 and of $C_2$ pulp samples was 22.3.

During the oxygen tests, a number of other measurements were taken. The shives, unbroken fiber bundles, were measured at points A and C. The average shive content was 2.2 percent of the oven-dry weight of the pulp at point A, and 0.67 percent of the oven-dry weight of the pulp at point C. The filtrate solids in the blow line material are 3.6 percent of the oven dry weight of the pulp.

The physical properties of the pulp were also tested. These properties were freeness, burst, tear, fold, breaking length, density and viscosity. Pulp samples are beaten in a PFI machine to a specified freeness, and the time to freeness, burst, tear, fold, breaking length, and density were determined. The freeness of the pulp, Canadian Standard Freeness (CSF), is determined by TAPPI Standard T 227 M-58, revised August 1958. Burst is a numerical value obtained by dividing the burst strength in grams per square centimeter by the basis weight of the sheet in grams per square meter and is determined by TAPPI Standard Test T 220 M-60, the 1960 Revised Tentative Standard. This test is also used to determine tear. Tear is a numerical value and equals 100 e/r in which e is the force in grams to tear a single sheet, and r is the weight of the sheet per unit area in grams per square meter. Fold, breaking length in meters and density in grams per cubic centimeter are determined by TAPPI Standard Test T 220 OS-71. Pulp viscosity is in centipoises and is determined by TAPPI Standard Method T 230 SU-66.

The results of these tests are given in Table III. Three sets of data are given. The first set is for an average of all the bleached pulps tested. The second set is for a specific sample of pulp. The third set is for a control pulp and is an average of tests of unbleached pulps produced on the apparatus before and after the bleaching trial.

TABLE III

| Physical Test Initial CSF | | Test Pulp Avg 703 | Test Pulp Sample 708 | Control Pulp 715 |
|---|---|---|---|---|
| Time to | 550 CSF | 30 min | 29 min | 34 min |
| Time to | 400 CSF | 49 min | 50 min | 53 min |
| Time to | 250 CSF | 67 min | 68 min | 70 min |
| Burst | Initial | 14.3 | 12.1 | 12.8 |
| Burst @ | 550 CSF | 64.4 | 62.1 | 67.1 |
| Burst @ | 400 CSF | 72.7 | 69.7 | 72.4 |
| Burst @ | 250 CSF | 75.6 | 73.1 | 74.3 |
| Tear | Initial | 229 | 206 | 225 |
| Tear @ | 550 CSF | 176 | 179 | 159 |
| Tear @ | 400 CSF | 160 | 157 | 151 |
| Tear @ | 250 CSF | 151 | 149 | 147 |
| Fold | Initial | 7 | 11 | 5 |
| Fold @ | 550 CSF | 610 | 705 | 545 |
| Fold @ | 400 CSF | 1045 | 1045 | 660 |
| Fold @ | 250 CSF | 1570 | 1365 | 810 |
| Breaking Length | Initial | 2700 m | 2700 m | 2700 m |
| Breaking Length @ Breaking | 550 CSF | 7700 m | 7300 m | 8000 m |

TABLE III-continued

| Physical Test Initial CSF | | Test Pulp Avg 703 | Test Pulp Sample 708 | Control Pulp 715 |
|---|---|---|---|---|
| Length @ Breaking | 400 CSF | 8700 m | 7800 m | 8500 m |
| Length @ | 250 CSF | 9000 m | 8200 m | 8900 m |
| Density | Initial | .49 | .49 | .47 |
| Density @ | 550 CSF | .58 | .58 | .58 |
| Density @ | 400 CSF | .61 | .62 | .60 |
| Density @ | 250 CSF | .62 | .63 | .62 |
| Viscosity | | 75 | 76 | 61 |

It was necessary during this test that the means for adding the oxygen, steam, and sodium hydroxide be of the simplest possible nature. In each instance, the chemicals were added through pipes extending into the blow line 22. The lines were upstream of refiner 21.

To determine the ability of oxygen to change the properties of pulp, a pulp having a Kappa number of 120 and a yield of 58.6 was treated with oxygen in pilot plant equipment. The equivalent of 20 kilograms of oxygen per metric ton of oven-dry pulp was applied to the pulp. The temperature was 90° C. Sodium hydroxide addition was 4% of the weight of the oven-dry pulp. No protector, such as magnesium oxide, was added. In fact, no protector was used in any of the experiments described in this application.

The treated pulp had a Kappa number of about 65. It was compared to a kraft pulp having a 58 Kappa number. The tests were at 675 Canadian Standard Freeness. The oxygen treated pulp had a ring crush 15% greater than the kraft pulp and a burst 2% greater than the kraft pulp.

Again the actual chemical application will depend upon the starting pulp and whether it is desired to increase properties or yield. The oxygen application may be from 12 to 50 kilograms per metric ton of oven-dry pulp. The alkali addition, expressed as sodium hydroxide, would normally be from 3.6 to 4.9% and the temperature would normally be from 82° to 95° C. A slight amount of protector might be used. This would not exceed 0.5% based on the weight of the oven-dry pulp.

The final product would have a Kappa ranging from 65 to 69; a ring crush, compared to a kraft pulp, of from 3% less when yield is increased to 28% more if better properties are desired; and a burst, compared to kraft pulp, of the same number if yield is increased to 6% greater if better properties are desired.

Much of the treatment would occur in the mixer and a majority in the mixer and through to the back pressure valve or top of the pipe in the mixer outlet line.

Figure 2:
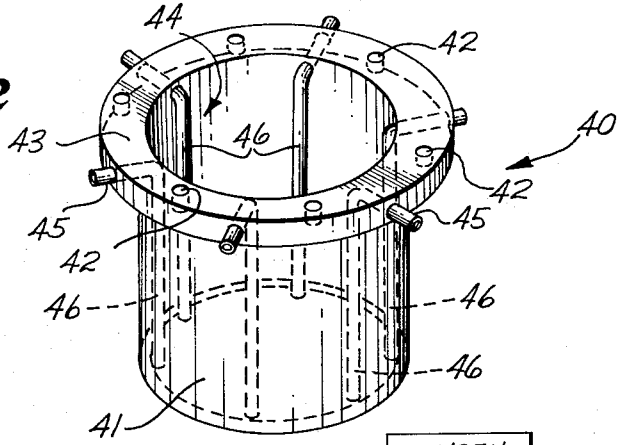
FIG. 2 is an isometric view of a diffuser used with a refiner to add the oxygen to the refiner.
Figure 3:
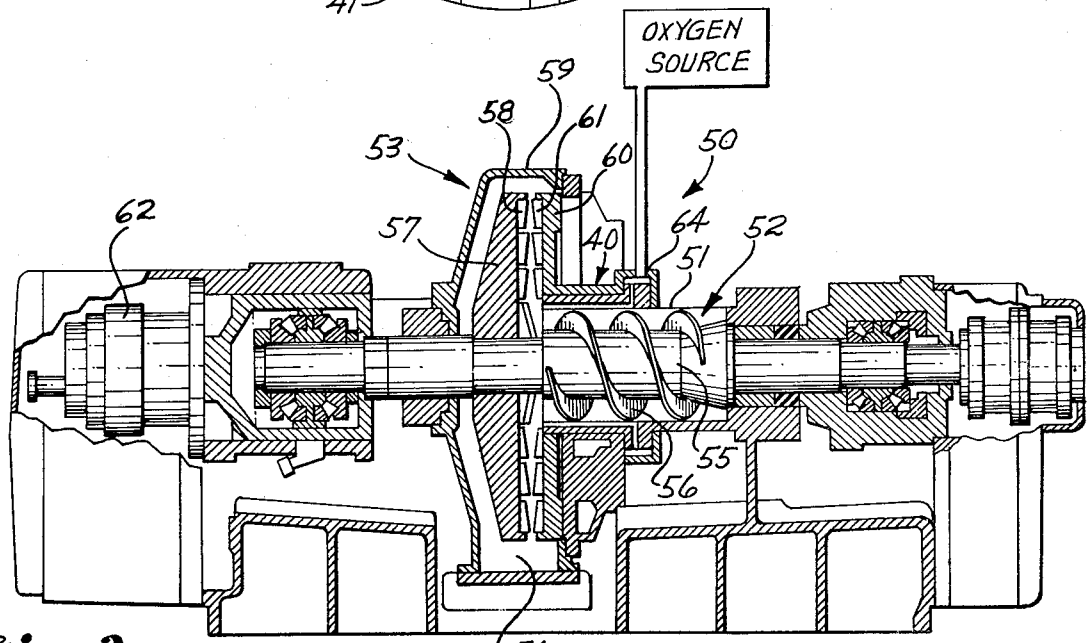

FIGS. 2, 3 and 4 show a unit that would provide better distribution of the oxygen. FIG. 2 shows the distribution unit by itself and FIGS. 3 and 4 show cross sections of refiners which include the unit.

The unit 40 consists of an inlet sleeve 41 which fits into the refiner casing inlet and is fixed in place by bolts which extend through holes 42 in flange 43. There are a plurality of L-shaped tubular diffusers 44 equally spaced and oriented axially around the sleeve and flange. Each diffuser has an inlet section 45 and an outlet section 46. The inlet section 45 extends radially along the flange 43 and the outlet section 46 extends longitudinally of the sleeve 41. The tube may have any cross section. There are several ways of attaching the diffusers 44 to the sleeve and flange. The inlet section 45 may be along the interior or exterior face of flange 43, be fitted in recesses in the interior or exterior face of flange 43, or be within and formed by the walls of the flange. In the latter design, an outlet tube would extend radially from the flange 43 as shown in FIG. 2. Similarly, the outlet section 46 could be affixed to the inner or outer wall of the sleeve 41, fitted into recesses in the inner or outer walls of the sleeve or be within and formed by the walls of the sleeve. They would be formed within and by the walls by casting when the sleeve and the flange are formed or by drilling through the wall. The preferred form is shown in FIG. 2. The inlet section 45 is formed in the flange and the outlet section 46 affixed to the inner wall of the sleeve. The diffuser will have one or more outlets for oxygen. Six diffusers should adequately disperse the oxygen in the pulp.

In FIG. 3, the unit is shown with a refiner. A single disc refiner is shown. Only the major portions of the refiner are identified.

The refiner 50 has an inlet 51, a screw conveyer section 52, a refiner section 53, and an outlet 54. The refiner shaft 55 is within the casing. Attached to the shaft are screw conveyer 56 and the revolving refiner member 57. The revolving refiner plate 58 is attached to member 57. Attached to the refiner casing 59 are the fixed refiner member 60 and the fixed refiner plate 61 which is aligned with revolving plate 58. The shaft 55, conveyer 56, revolving refiner member 57 and plate 58 are rotated by a suitable motor 62.

In this refiner, the unit 40 would be part of the wear plate for the conveyer. The diffusers 44 would either be recessed in the sleeve 41 or formed in the sleeve as described above. This would allow the oxygen to be admitted after the conveyer section. Oxygen is fed to the diffusers through the oxygen manifold 64. The oxygen enters the diffusers 44 through the manifold 64 and is added to the pulp after the conveyer 56. The oxygenated pulp leaves the refiner through the outlet 54.

The blow line 22 is attached to inlet 51.

FIG. 4 shows the use of unit 40 in a refiner that does not have a conveyer section. The reference numerals are the same as in FIG. 3.

In any type of refiner there is relative rotative movement between two opposed surfaces which are spaced to allow passage of material between them. Disc refiners are normally used because of the ability to change the clearance and pressure on the plates, depending on the furnish to the refiner and the end product desired. There are other types of refiners that may be used. In the usual double disc refiner, the rotating disc has refiner plates on both faces which act against opposing fixed plates. Another type of double disc refiner has both refiner plates mounted on discs which rotate in opposite directions to provide both a rolling and an abrading action. The discs are mounted on separate shafts which may be concentric. A conical refiner may also be used.

In some installations, there is no refiner in the blow line between the continuous digester 15 and the blow tank 24. It is now possible to achieve good treatment by the simple addition of the alkali, steam and oxygen lines, and a mixer, such as mixer 40, into the blow line. This is shown in FIG. 5. The other reference numerals are the same as those in FIG. 1.

Mixer 40 may be a refiner such as the refiner shown in FIGS. 3 or 4. For example, the refiner, when stopped, may be used as a mixing device. The clearance between discs has been tested at around 13 mm and can be up to 75 mm. The clearance can be smaller. This narrow passage causes the pulp slurry and oxygen to mix. Any other type of suitable mixer may be used.

Mixer 40 may also be a mixer such as the one shown in FIGS. 6–15. The mixer 70 has a cylindrical body 71 and two head plates 72 and 73. The pulp slurry enters through pipe 74, passes through the body of the mixer and exits through pipe 75. The oxygen manifolds 78, which supply oxygen to the stators 100 within the mixer are supplied by oxygen lines 79.

A shaft 80 extends longitudinally of the mixer and is supported on bearings 81 and 82 and is rotated by rotational means 83. A chain belt drive is shown, but any other type of rotational means may be used.

Rotors 85 are attached to the shaft 80. Each rotor 85, shown in FIGS. 9–10, has a body 86 which is tapered outwardly from the shaft and a cross section that has an elliptically generated shape. The preferred cross section is an ellipse. The major axis of the rotor is aligned with the direction of rotation of the rotor. Each of its leading and trailing edges 87 and 88 has a radius of the curvature in the range of 0.5 to 15 mm. The radii are usually the same but need not be. If different, then the leading edge would have a greater radius than the trailing edge.

A modification is shown in FIGS. 11 and 12. A groove 89 is formed in the trailing edge 88' of the rotor. The groove is about 0.1 mm across. The groove may be coated with a hydrophobic material.

The number of rotors and the speed of the rotors will depend on the amount of pulp passing through the mixer and the consistency of the pulp passing through the mixer. The area swept by the rotors should be in the range of 10,000 to 1,000,000 square meters per metric ton of oven-dry pulp. The preferred range is 25,000 to 150,000 square meters per metric ton of oven-dry pulp and the optimum is considered to be around 65,400 square meters per metric ton of oven-dry pulp. This area is determined by the formula $$A = \frac{1440\,\pi\,(r_1^2 - r_2^2)\,(R)\,(N)}{t}$$

where

A = area swept per metric ton, $m^2/t$
$r_1$ = outer radius of the rotor, m
$r_2$ = inner radius of the rotor, m
R = revolutions per minute of the rotor
N = number of rotors
t = metric tons (Oven Dry Basis) of pulp passing through the mixer per day.

There is a trade-off between the length of the individual rotors and the number of rotors. The rotors are usually arranged in rings on the central shaft. The number of rotors in a ring will depend upon the circumference of the central shaft and the size of the rotor base. A greater number of rotors would require a longer and stiffer shaft. Fewer rotors would require longer rotors. Consequently, space for the mixer would determine the actual rotor configuration. Normally, there are a total of 4 to 400 rotors, and from 2 to 20 rotors in a ring.

The rotors rotate transversely to the direction of pulp movement through the mixer, describing a helical path through the pulp. The speed of rotation of the rotors would be determined by the motor, and the drive ratio between the motor and the central shaft.

The diameter of the central shaft 80 is at least one half of the internal diameter of the mixer, forming an annular space 90 through which the slurry passes.

The enlarged shaft requires scraper bars 91 and 92 attached to the shaft end walls 93 and 94. The bars remove fibers that tend to build up between the shaft end walls and the mixer head plate. This prevents binding of the shaft in the mixer.

The stators are shown in FIGS. 13 and 14. The stators add oxygen to the pulp in the mixing zone and also act as friction devices to reduce or stop the rotation of the pulp with the rotors so that there is relative rotative movement between the rotors and the pulp. Each stator 100 has a body 101, a central passage 102 and a base plate 103. The stators extend through apertures 104 in body 71 and may be attached to the body 71 of the mixer by a friction fit using a Van Stone flange, or, as shown, directly to the body 71 with either bolts or studs. The oxygen enters the mixer through check valves 105. The stators are round and tapered and the face 106 in which the check valves are mounted is flattened. The check valves face across a transverse plane of the mixer and in the direction of rotation of the rotors.

The purpose of the check valves 105 is to prevent the pulp fibers from entering the passage 102. A typical check valve is shown in FIG. 15. The valve 105 consists of a valve body 107 which is threaded into stator body 101. The valve body has a valve seat 108. The valve itself consists of a bolt 109 and nut 110 which are biased into a closed position by spring 111.

The number of check valves in a stator may vary from 0 to 4. In some mixers, the major portion of the gas would be added at the mixer entrance, requiring up to 4 check valves and little or no gas would be added near the mixer exit, requiring 1 check valve or no check valve. These latter stators would then only act as friction drag against pulp rotation. For example, between 60 to 70% of the oxygen could be added in the first half of the mixer. The first one third of the stators would have 3 or 4 check valves, the next one third might have 2 check valves, and the last one third might have 1 or no check valves.

The stators may also be arranged in rings. There should be one ring of stators for each 1 or 2 rings of rotors. The number of stators in a ring will depend on the size of the mixer. Usually, there are 4 stators in a ring but this can normally vary from 2 to 8.

Both the rotors and the stators should extend across the annular space. A normal clearance between the rotor and the opposing inner wall of the mixer, or the stator and the outer wall of the central shaft is about 13 mm. This ensures that all of the pulp is contacted and mixed with the oxygen and there is no short circuiting of the pulp through the mixer without contact with oxygen.

The rotors and stators should be between the inlet and outlet to ensure that all the pulp passes through the swept area and is contacted with oxygen.

A mixer which could be used for 810 metric tons of pulp per day on an oven-dry basis would have an internal diameter of 0.914 m and a central shaft 0.508 m in diameter. There would be 203 elliptical and linearly tapered rotors 19 cm long. The major axis of the ellipse would extend in the direction of rotation. The leading and trailing edges of the rotor would have radii of curvature of 3.8 mm. The speed of rotation would be 435 RPM and the swept area would be 65,400 square meters per metric ton of oven-dry pulp. Oxygen would be admitted incrementally into the mixing zone through the round tapered stators, also 19 cm long.

There should be a back pressure on the pulp in the mixer or refiner. This may be provided by an upflow line which creates a hydrostator head at the mixer. A pressure valve is preferred. The valve may be placed in the blow line 23 downstream of the refiner 21 or line 23' downstream of the mixer 40. The valve may be either right after the mixer or refiner or at the top of the line before the outlet.

The maximum pressure in the mixer or refiner would normally not exceed 830 kPa gage, and the pressure at the top of the pipe would normally not exceed 345 kPa gage.

A mill trial was run using a similar system. In this system, the mixer was floor mounted and the pipe carried the slurry from the mixer to the top of a tower. The tower was open to the atmosphere. A partially closed valve near the outlet of the pipe created a 276 kPa gage back pressure in the line. The hydrostatic pressure in the line was 241.5 kPa gage so the pressure within the mixer was 517.5 kPa gage.

Four trial runs were made under slightly different conditions to determine both the overall delignification effect of the system and the percentage of delignification taking place within each section of the system. K number measurements were taken before and after the mixer, at the outlet of the pipe, at the outlet of the tank, and at the outlet of a decker downstream of the tank.

In a control run in which no oxygen was added to the system, it was determined that the K number was reduced 1 number between the inlet of the mixer and the outlet of the decker. This probably was due to screening. In the overall delignification computation, the numbers were corrected for this 1 K number drop.

The various K numbers were taken within the system to determine the percentage of the total delignification or K number reduction taking place through the mixer, through the pipe, through the tank, and through the decker. The decker had been converted to a washer for these tests. The slurry required between 10 to 15 seconds to pass through the mixer, 2½ to 3½ minutes through the pipe, ½ to 3 hours through the tank or decker. It was determined that in these tests, 30% of the total delignification occurred in the mixer, 40% occurred in the pipe, 8% occurred in the tank, and 21% occurred between the tank and the decker. This latter reduction is caused by screening of the pulp.

Table IV gives the actual conditions in the mixer: the temperature in degrees C.; the kilograms of caustic, expressed as sodium hydroxide, and oxygen per oven-dry metric ton of pulp; the pressure in kilopascals gage; the K numbers at the various locations within the system; and the percent K number reduction. In Run No. 1, the percent reduction at the decker outlet in the last line is the reduction between the top of the pipe and the decker outlet.

TABLE IV

| | Runs | | | |
|---|---|---|---|---|
| | 1 | 2 | 3 | 4 |
| Mixer Conditions | | | | |
| Temp. °C. | 79.5 | 82 | 93 | 88 |
| Caustic, kg/O.D.t. | 15.1 | 20.2 | 15.1 | 20.2 |
| Oxygen, kg/O.D.t. | 22.7 | 25.2 | 20.2 | 25.2 |
| Pressure, kPa gage | 517.5 | 517.5 | 517.5 | 517.5 |
| Overall Delignification | | | | |
| Before Mixer | | | | |
| K No. | 19.6 | 25.4 | 19.9 | 24.1 |
| K No. Corrected | 18.6 | 24.4 | 18.9 | 23.1 |
| After Decker | | | | |
| K No. | 15.6 | 19.2 | 15.1 | 17.8 |
| % K No. Reduction | 16 | 21 | 20 | 23 |
| Delignification Within System | | | | |
| Mixer Inlet | | | | |
| K No. | 19.6 | 25.4 | 19.9 | 24.1 |
| Mixer Outlet | | | | |
| K No. | 18.5 | 23.3 | 18.6 | 21.3 |
| % of Total Reduction | 25 | 34 | 27 | 29 |
| Top of Pipe | | | | |
| K No. | 16.8 | 21.5 | 16.0 | 19.8 |
| % of Total Reduction | 44 | 29 | 54 | 40 |
| Tank Outlet | | | | |
| K No. | — | 20.5 | 16.0 | 19.3 |
| % of Total Reduction | — | 16 | 0 | 8 |
| Decker Outlet | | | | |
| K No. | 15.6 | 19.2 | 15.1 | 17.8 |
| % of Total Reduction | 31 | 21 | 19 | 23 |

This data indicates both that in any of the systems described in this application, a valve may be placed in the line downstream of the oxygen mixer or refiner to provide back pressure on the mixer or refiner, and that most of the delignification occurs less than a minute in the mixer or refiner, or in a few minutes in the pipe immediately after the mixer or refiner. The mixer has also been operated under a hydrostatic pressure only.

What is claimed is:

1. A wood pulp process comprising continuously digesting wood chips with chemicals under heat and pressure to form delignification products and delignified wood chips, removing at least a part of said delignification products, forming wood pulp from said delignified wood chips by partially releasing the pressure from said wood chips, transporting a slurry containing said wood pulp and remaining delignification products under pressure to a storage tank, and storing said slurry in said tank, prior to said storage, adjusting the pH of said slurry to a pH in the range of 8 to 14, between said pH adjustment and said storage, adding oxygen to said slurry, between said pH adjustment and said storage, mixing said oxygen with said slurry in a mixing zone in which a plurality of rotating members pass through said slurry in a direction transverse the direction of travel of said slurry, said members having a major axis extending in the direction of rotation, said members providing a swept area through said slurry of 10,000 to 1,000,000 square meters per metric ton of oven dry pulp, said members having leading and trailing edges, said leading edge having a radius of curvature in the range of 0.5 to 15 mm.

2. The process of claim 1 in which said swept area is 25,000 to 150,000 square meters per metric ton of oven dry pulp.

3. The process of claim 1 in which said swept area is around 65,400 square meters per metric ton of oven dry pulp.

4. The process of claims 1, 2 or 3 in which said members have elliptically generated cross sections having a major axis extending in the direction of rotation.

5. The process of claims 1, 2 or 3 in which said mixing occurs in an annular space in which the interior surface of said space has a radius of at least one half of the radius of the exterior surface of said space.

6. The process of claims 1, 2 or 3 in which said trailing edge has a radius of curvature in the range of 0.5 to 15 mm.

7. The process of claims 1, 2 or 3 in which said oxygen is added incrementally to said slurry.

8. The process of claims 1, 2 or 3 in which the amount of oxygen added to said slurry is from 5 to 50 kilograms per metric ton of oven dry pulp.

9. The process of claims 1, 2 or 3 in which said pH is adjusted by adding alkali, expressed as sodium hydroxide, in an amount in the range of 0.25 to 8% based on the oven dry weight of said pulp.

10. The process of claims 1, 2 or 3 further comprising prior to said mixing, heating said slurry to a temperature in the range of around 65° C. to around 121° C. during said mixing.

11. The process of claims 1, 2 or 3 in which said slurry is subject to a pressure of up to 830 kPa gage during said mixing.

12. A wood pulp process comprising continuously digesting wood chips with chemicals under heat and pressure to form delignification products and delignified wood chips, removing at least a part of said delignification products, forming wood pulp from said delignified wood chips by partially releasing the pressure from said wood chips, transporting a slurry containing said wood pulp and remaining delignification products under pressure to a diffusion washer, washing said pulp in said diffusion washer, prior to said diffusion washing, adjusting the pH of said slurry to a pH in the range of 8 to 14, between said pH adjustment and said diffusion washing, adding oxygen to said slurry, between said pH adjustment and said diffusion washing, mixing said oxygen with said slurry in a mixing zone in which a plurality of rotating members pass through said slurry in a direction transverse the direction of travel of said slurry, said members having a major axis extending in the direction of rotation, said members providing a swept area through said slurry of 10,000 to 1,000,000 square meters per metric ton of oven dry pulp, said members having leading and trailing edges, said leading edge having a radius of curvature in the range of 0.5 to 15 mm.

13. The process of claim 12 in which said swept area is 25,000 to 150,000 square meters per metric ton of oven dry pulp.

14. The process of claim 12 in which said swept area is around 65,400 square meters per metric ton of oven dry pulp.

15. The process of claims 12, 13 or 14 in which said members have elliptically generated cross sections having a major axis extending in the direction of rotation.

16. The process of claims 12, 13 or 14 in which said mixing occurs in an annular space in which the interior surface of said space has a radius of at least one half of the radius of the exterior surface of said space.

17. The process of claims 12, 13 or 14 in which said trailing edge has a radius of curvature in the range of 0.5 to 15 mm.

18. The process of claims 12, 13 or 14 in which said oxygen is added incrementally to said slurry.

19. The process of claims 12, 13 or 14 in which the amount of oxygen added to said slurry is from 5 to 50 kilograms per metric ton of oven dry pulp.

20. The process of claims 12, 13 or 14 in which said pH is adjusted by adding alkali, expressed as sodium hydroxide, in an amount in the range of 0.25 to 8% based on the oven dry weight of said pulp.

21. The process of claims 12, 13 or 14 further comprising prior to said mixing, heating said slurry to a temperature in the range of around 65° C. to around 121° C. during said mixing.

22. The process of claims 12, 13 or 14 in which said slurry is subject to a pressure of up to 830 kPa gage during said mixing.

23. A pulping apparatus comprising a continuous digester for continuously digesting wood chips to form delignification products and delignified wood chips, and a washer associated with said digester for removing at least a part of said delignification products, said digester having a pressure relief valve for forming wood pulp from said delignified wood chips by partially releasing the pressure from said wood chips, a pipe for transporting a slurry containing said wood pulp and remaining delignification products under pressure from said digester to a storage tank, and said storage tank, means, prior to said storage tank, for adding a pH adjustment chemical to said slurry, means, between said pH adjustment chemical addition means and said storage tank, for adding oxygen to said slurry, and means, prior to said storage tank, for mixing said oxygen with said slurry, said mixing means having a mixing zone, a plurality of rotors in said mixing zone, said rotors having leading and trailing edges, said leading edge having a radius of curvature in the range of 0.5 to 15 mm.

said rotors having a major axis extending in the direction of rotation, said rotors being rotatable through said slurry in a direction transverse to the direction of travel of said slurry, means for rotating said rotors, and said rotors providing a swept area of from 10,000 to 1,000,000 square meters per metric ton of oven dry pulp.

24. The apparatus of claim 23 in which said rotors provide a swept area of 25,000 to 150,000 square meters per metric ton of oven dry pulp.

25. The apparatus of claim 23 in which said rotors provide a swept area of around 65,400 square meters per metric ton of oven dry pulp.

26. The apparatus of claims 23, 24 or 25 in which said rotors have elliptically generated cross sections having a major axis extending in the direction of rotation.

27. The apparatus of claims 23, 24 or 25 in which said mixing zone is an annular space in which the interior surface of said space has a radius of at least one-half of the radius of the exterior surface of said space.

28. The apparatus of claims 23, 24 or 25 in which said trailing edge has a radius of curvature in the range of 0.5 to 15 mm.

29. The apparatus of claims 23, 24 or 25 further comprising means, prior to said mixing means, for heating said slurry so that it will be at a temperature in the range of around 65° C. to around 121° C. in said mixing means.

30. The apparatus of claims 23, 24 or 25 further comprising a plurality of stators extending into said mixing zone, at least some of said stators having a first passage extending from outside of said mixing zone lengthwise through said stator and a second passage communicating between said first passage and said mixing zone, and a check valve in said second passage.

31. The apparatus of claims 23, 24 or 25 further comprising a valve in said pipe between said mixing means and said storage tank.

32. A pulping apparatus comprising a continuous digester for continuously digesting wood chips to form delignification products and delignified wood chips, and a washer associated with said digester for removing at least a part of said delignification products, said digester having a pressure relief valve for forming wood pulp from said delignified wood chips by partially releasing the pressure from said wood chips, a pipe for transporting a slurry containing said wood pulp and remaining delignification products under pressure from said digester to a diffusion washer, and said diffusion washer, means, prior to said diffusion washer, for adding a pH adjustment chemical to said slurry, means, between said pH adjustment chemical addition means and said diffusion washer means, for adding oxygen to said slurry, and means, prior to said diffusion washer, for mixing said oxygen with said slurry, said mixing means having a mixing zone, a plurality of rotors in said mixing zone, said rotors having leading and trailing edges, said leading edge having a radius of curvature in the range of 0.5 to 15 mm, said rotors having a major axis extending in the direction of rotation, said rotors being rotatable through said slurry in a direction transverse to the direction of travel of said slurry, means for rotating said rotors, and said rotors providing a swept area of from 10,000 to 1,000,000 square meters per metric ton of oven dry pulp.

33. The apparatus of claim 32 in which said rotors provide a swept area of 25,000 to 150,000 square meters per metric ton of oven dry pulp.

34. The apparatus of claim 32 in which said rotors provide a swept area of around 65,400 square meters per metric ton of oven dry pulp.

35. The apparatus of claims 32, 33 or 34 in which said rotors have elliptically generated cross sections having a major axis extending in the direction of rotation.

36. The apparatus of claims 32, 33 or 34 in which said mixing zone is an annular space in which the interior surface of said space has a radius of at least one-half of the radius of the exterior surface of said space.

37. The apparatus of claims 32, 33 or 34 in which said trailing edge has a radius of curvature in the range of 0.5 to 15 mm.

38. The apparatus of claims 32, 33 or 34 further comprising means, prior to said mixing means, for heating said slurry so that it will be at a temperature in the range of around 65° C. to around 121° C. in said mixing means.

39. The apparatus of claims 32, 33 or 34 further comprising a plurality of stators extending into said mixing zone, at least some of said stators having a first passage extending from outside of said mixing zone lengthwise through said stator and a second passage communicating between said first passage and said mixing zone, and a check valve in said second passage.

40. The apparatus of claims 32, 33 or 34 further comprising a valve in said pipe between said mixing means and said diffusion washer.

* * * * *